United States Patent [19]

Hunter

[11] 4,175,821

[45] Nov. 27, 1979

[54] ELECTRICAL CONNECTOR

[75] Inventor: Bradley L. Hunter, Hollis, N.H.

[73] Assignee: Teradyne, Inc., Boston, Mass.

[21] Appl. No.: 905,959

[22] Filed: May 15, 1978

[51] Int. Cl.[2] ..... H01R 13/12

[52] U.S. Cl. ..... 339/258 R

[58] Field of Search ..... 339/258 R, 258 P, 256 R

[56] References Cited

U.S. PATENT DOCUMENTS

| | | | |
|---|---|---|---|
| Re. 29,513 | 1/1978 | Johnson | 339/112 R |
| 3,818,423 | 6/1974 | McDonough | 339/258 P |

FOREIGN PATENT DOCUMENTS

| | | | |
|---|---|---|---|
| 1187074 | 9/1959 | France | 339/258 P |
| 1374648 | 8/1964 | France | 339/258 R |

*Primary Examiner*—Neil Abrams

[57] ABSTRACT

A socket contact with a pair of generally longitudinally extending beams for gripping a contact post, the beams being cantilevered from transversely aligned ends of arms the other ends of which are transversely spaced and extend from the contact base, some of the arms being bent outwardly and curved transversely to achieve the transverse alignment.

1 Claim, 6 Drawing Figures

ELECTRICAL CONNECTOR

FIELD OF THE INVENTION

This invention relates to electrical contacts, particularly socket contacts suited for mating with male contact posts.

BACKGROUND OF THE INVENTION

In making electrical connections with printed circuit boards, it is desirable to provide socket contacts with two spaced-apart metal cantilever beams for tightly gripping male contact posts. With single cantilever beam construction, the plastic member positioned opposite the single beam to oppose the gripping force has a tendency to creep and deform with age and thereby reduce the life and reliability of the socket. It is also desirable to provide a compact socket structure, for space considerations typically require that the socket contacts be tightly stacked into overlaying rows adjacent one board edge. To assure good electrical contact, precious metals (e.g., gold over nickel) are often selectively applied to the beams in the region where they contact the posts. The precious metal can be applied by stamping the contacts from a sheet of base metal having a strip of precious metal inlayed or welded to it or by dipping the contact into a plating bath. With either process it is important to minimize the amount of precious metal used.

Known socket contacts with dual cantilever beams employ a longitudinally extending box to surround the contact post. The post is received through an open transverse end and the cantilever beams are supported from opposite sides of the box. The box and beams are stamped as an integral piece and then folded into final shape.

Johnson U.S. Pat. No. Re. 29,513 shows a socket contact constructed by folding one end of a generally flat strip backward longitudinally over itself, with the folded end forming a cantilever beam, and cutting a hole in the vicinity of the fold to provide an entrance for the contact post.

SUMMARY OF THE INVENTION

I have discovered that the advantages of dual cantilever beam construction can be provided in a socket contact without the complexity of a box construction and with the capability of mating with short contact posts. The socket portion of my new contact has a pair of generally longitudinally extending beams for gripping a contact post, the beams being cantilevered from transversely aligned ends of arms the other ends of which are transversely spaced and extend from the contact base, some of the arms being bent outwardly and curved transversely to achieve the transverse alignment. Contact portions are provided near the unsupported ends of the beams for conductively engaging the short contact post. Outward springiness in the beams and arms provides a tight grip on the post.

In preferred embodiments, three integral arms extend from the contact base. The two outside arms are bent upwardly, curved transversely toward each other, and joined together over the central arm. The cantilever beams are integral with the arms, one extending from the junction of the two outside arms, the other from the central arm. Each beam is flared outwardly at its unsupported ends to facilitate acceptance of the contact post and to better define the contact portions. Gold and nickel layers are applied to one contact portion.

In manufacturing the new socket by stamping sheet metal, a more compact pattern can be used than that for a box construction, and the pattern is shaped such that portions requiring precious metal can be interleaved in a single strip of the precious metal, all of which reduces material costs. Furthermore, assembly of the new contacts and insertion of them into a connector can be accomplished more simply. Forward placement of the contact portions allows the socket to mate with much shorter contact posts than are required for the Johnson U.S. Pat. No. Re. 29,513 contact and makes more economical dipping of the socket to plate it with precious metal, for the contact portions to be plated are adjacent to one end of the socket. What is more, no entrance hole is required for the post as in Johnson, further reducing material waste.

PREFERRED EMBODIMENT

We turn now to the structure, manufacture, and operation of a preferred embodiment of the invention, after first briefly describing the drawings.

Figure 2:
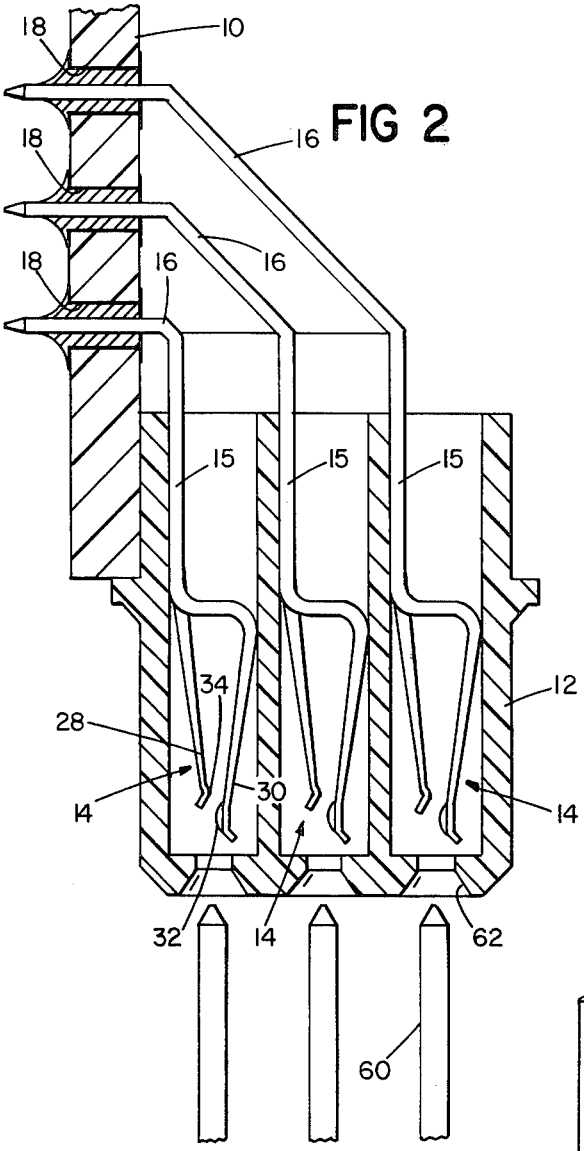
FIG. 2 is a sectional view taken through 2—2 of FIG. 1.
Figure 3:
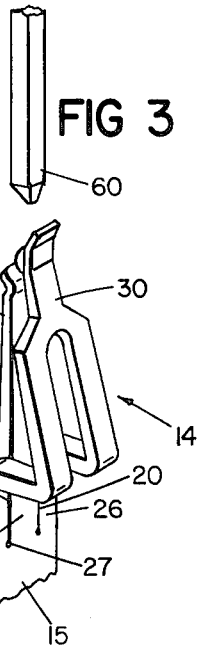
FIG. 3 is a partial isometric view of one contact, showing the two cantilever beams.
Figure 1:
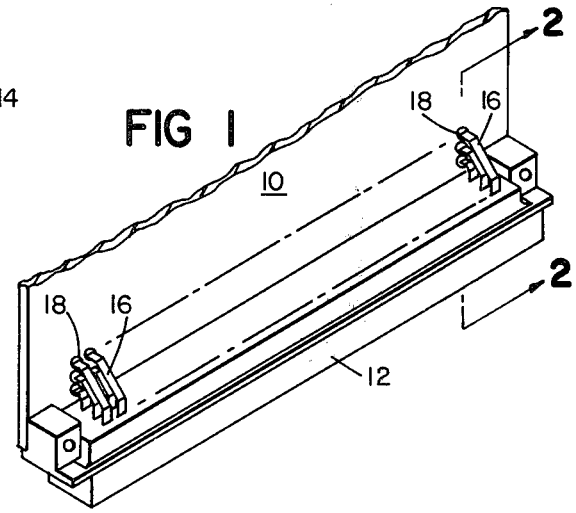
FIG. 1 is an isometric view of a printed circuit board and connector incorporating the preferred contact embodiment.

Turning to FIGS. 1, 2, and 3, there is shown printed circuit board 10 on one end of which is fastened connector 12. Socket contacts 14 are arranged within connector 12 in three parallel rows (FIG. 2). Each contact 14 has a base 15 from which varying length legs 16 extend into plated holes 18 in board 10, where they are secured with solder and connected to printed circuit paths. The base is separated by two cuts 19, 20 into three transversely spaced arms 22, 24, 26. Small holes 27 at the ends of each cut prevent tear propagation. Central arm 24 supports integral cantilever beam 28. Outside arms 22, 26 are bent outward from and then parallel to base 15 and are curved toward each other to overlap arm 24 and support at their junction cantilever beam 30. Beams 28, 30 converge inwardly toward their unsupported ends where each is flared out slightly to facilitate receiving male contact post 60 and to define contact regions 32, 34 on their inside surfaces. Contact region 32 is inlayed with precious metal (gold outer layer on nickel inner layer).

Figure 4:
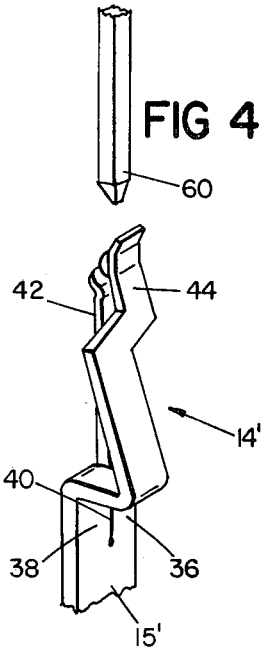
FIG. 4 is a partial isometric view of an alternative contact embodiment.

An alternative contact 14′ is shown in FIG. 4. Base 15′ is separated into two transversely spaced arms 36, 38 by single cut 40. Arm 36 supports integral cantilever beam 42; arm 38 is bent outward and curved transversely to overlap arm 36, and it supports cantilever beam 44. The beams are identical to beams 28, 30 of the preferred embodiment.

Figure 5:
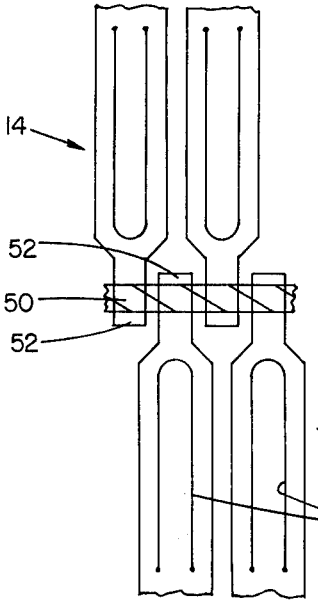
FIG. 5 is a diagrammatic plan view of the stamping pattern for the preferred contact embodiment.

Turning to FIG. 5, there is diagrammatically shown a stamping pattern for use in cutting individual contacts 14 from a large sheet of copper alloy (0.012 inch thick) having precious metal inlay strip 50 running centrally therethrough (0.005 inch thick).

Figure 6:
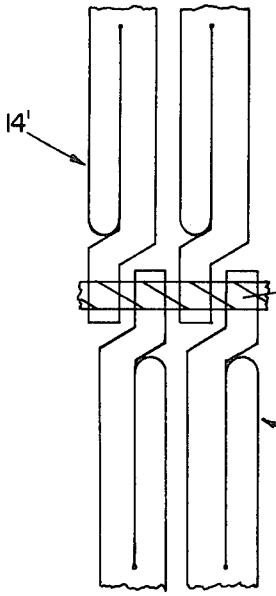
FIG. 6 is a diagrammatic plan view of the stamping pattern for the alternative contact embodiment.

Narrowed portions 52 which will become beams 30 are interleaved across previous metal strip 50. U-shaped cut 54 defines the shape of the portions to become arms 22, 24, 26 and beam 28. To form the finished contact, two roughly 90° bends are made in arms 22, 26; beams 28, 30 are bent inward toward each other; and the tips of the beams are flared outward slightly. A stamping pattern is shown in FIG. 6 for manufacturing alternative contact 14'. Cutting and bending operations similar to those described are used for this embodiment.

Instead of using a precious metal inlay, contacts 14 could be cut from a plain copper alloy sheet and the finished contact dipped into plating bath just deep enough to coat the tip of beam 30 first with nickel and then with gold.

In operation, contact posts 60 (copper alloy with gold and nickel plated layers) are inserted through chamfered holes 62 and between beams 28, 30 sufficiently far enough to bring contact regions 32, 34 into engagement with the post. The beams and arms are spread apart on insertion and act as springs to tightly grip the posts.

Other embodiments are within the scope of the description and claims.

What is claimed is:

1. An electrical socket contact for conductively engaging a post, said contact comprising:

a base including a first end portion for connection with an electrical circuit and a second end portion spaced longitudinally from said first end portion and separated into a plurality of transversely spaced arms, at least one of said arms being curved transversely and at least one of said arms being bent outwardly from said base such that at least two arms overlap each other, the outward direction being perpendicular to the transverse and longitudinal directions; and a socket portion adjoining said second end portion of said base and including a pair of generally longitudinally extending beams, said beams each being cantilevered from at least one of said overlapping arms, said beams being outwardly spaced apart and transversely aligned, said beams including contact portions near their unsupported ends for conductively engaging said post, and said beams and arms having sufficient outward springiness to springily grip said post between said contact portions; wherein said second end portion of said base is separated into three arms, the two transversely outside arms are bent outwardly from said base and curved transversely toward each other so as to join at a junction and overlap the third arm positioned centrally between them, and one of said beams extends from said junction between said two curved arms; and wherein said arms, beams and base are integral and the aperture defined inside the two joined outside arms corresponds in shape to the third arm and cantilevered beam extending from it, whereby a U-shaped cut made longitudinally in said contact produces inside the U-shape the third arm and beam and outside the U-shape the two joined arms and beam.

* * * * *